US007695829B2

(12) United States Patent
Yamamoto et al.

(10) Patent No.: US 7,695,829 B2
(45) Date of Patent: Apr. 13, 2010

(54) HARD FILM AND HARD FILM-COATED TOOL

(75) Inventors: Kenji Yamamoto, Kobe (JP); Susumu Kujime, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 330 days.

(21) Appl. No.: 11/774,990

(22) Filed: Jul. 9, 2007

(65) Prior Publication Data

US 2008/0075976 A1 Mar. 27, 2008

(30) Foreign Application Priority Data

Sep. 21, 2006 (JP) ..... 2006-255149

(51) Int. Cl.
*B23B 27/14* (2006.01)

(52) U.S. Cl. ..... 428/697; 51/307; 51/309; 428/698; 428/699; 428/704

(58) Field of Classification Search ..... 51/307, 51/309; 428/697, 698, 699, 701, 702, 704
See application file for complete search history.

(56) References Cited

U.S. PATENT DOCUMENTS

| | | | | |
|---|---|---|---|---|
| 6,309,738 | B1 * | 10/2001 | Sakurai | 428/697 |
| 6,586,122 | B2 * | 7/2003 | Ishikawa et al. | 428/698 |
| 6,824,601 | B2 * | 11/2004 | Yamamoto et al. | 428/699 |
| 2007/0099028 | A1 | 5/2007 | Yamamoto et al. | |
| 2007/0172694 | A1 | 7/2007 | Yamamoto | |
| 2007/0184306 | A1 | 8/2007 | Yamamoto et al. | |

FOREIGN PATENT DOCUMENTS

| | | | |
|---|---|---|---|
| CN | 1504589 A | | 6/2004 |
| CN | 1642682 A | | 7/2005 |
| CN | 1942605 A | | 4/2007 |
| JP | 09-041127 | * | 2/1997 |
| JP | 2644710 | | 5/1997 |
| JP | 10-251832 | | 9/1998 |
| JP | 2003-71610 | | 3/2003 |
| JP | 2003-71611 | | 3/2003 |
| KR | 2002-0055444 | | 7/2002 |
| WO | WO 2005/100635 A1 | | 10/2005 |
| WO | WO 2006/005217 A2 | | 1/2006 |

OTHER PUBLICATIONS

U.S. Appl. No. 12/250,226, filed Oct. 13, 2008, Yamamoto.
U.S. Appl. No. 11/774,990, Jul. 9, 2007, Yamamoto, et al.

* cited by examiner

*Primary Examiner*—Archene Turner
(74) *Attorney, Agent, or Firm*—Oblon, Spivak, McClelland, Maier & Neustadt, L.L.P.

(57) ABSTRACT

A hard coating film to be applied to the surface of a tool, said hard coating film having a composition represented by the formula $Al_{1-a-b-c}Si_aMg_bM_c(B_xC_yN_z)$, where M denotes at least one species of elements selected from Nb, V, Zr, Cr, Ti, Cu, and Y, and a, b, c, x, y, and z represent atomic ratios such that $0 \leqq a \leqq 0.35$, $0 \leqq b \leqq 0.2$, $0.03 \leqq a+b \leqq 0.5$, $0 \leqq c \leqq 0.1$, $0.9 \leqq Al+Si+Mg$, $0 \leqq x \leqq 0.2$, $0 \leqq y \leqq 0.4$, $0.5 \leqq z \leqq 1$, and $x+y+z=1$. A tool coated with the hard coating film defined above. The hard coating film has excellent wear resistance owing to its improved hardness, oxidation resistance, and toughness. It is used for coating on a tool to improve wear resistance.

9 Claims, 2 Drawing Sheets

HARD FILM AND HARD FILM-COATED TOOL

BACKGROUND OF THE INVENTION

1. Field of the Invention

The present invention relates to a hard film which covers the surface of a tool and a hard film-coated tool having said hard film.

2. Description of the Related Art

Coating with a hard film of TiN, TiC, TiCN, TiAlN, or the like has been a common practice of improving the wear resistance of cutting tools, such as chips, drills, and end mills, and jigs, such as presses, forging dies, and punches, which are made of cemented carbide, cermet, high-speed cutting steel, or the like. Typical of such hard film is composite nitride film (TiAlN) composed of Ti and Al. Because of its excellent wear resistance, it is superseding conventional hard films of titanium carbide, nitride, or carbonitride mentioned above, and it is finding application to high-speed cutting tools and cutting tools for hard materials such as quenched steel.

Notable among the above-mentioned TiAlN coating films characterized by high hardness and excellent wear resistance is the one which has the crystalline structure of NaCl type and hence excels in oxidation resistance at high temperatures. (See Patent Document 1 below.)

There has also been proposed a new coating film with improved wear resistance which is composed of TiAlN and additional Cr, the latter contributing to the increased Al content and the increased hardness and oxidation resistance while retaining the rock salt crystalline structure (cubic crystal) for high hardness. (See Patent Document 2 below.) Other coating films proposed so far include the one composed of TiCrAlN and additional Si and B for improved oxidation resistance (see Patent Document 3 below) and the one composed of CrAlN and additional Nb, Si, and B for improved oxidation resistance (See Patent Document 4 below).

Patent Document 1:
Japanese Patent No. 2644710 (Paragraphs 0011-0018)

Patent Document 2:
Japanese Unexamined Patent Application Publication No. 2003-71610 (Paragraphs 0018-0023)

Patent Document 3:
Japanese Unexamined Patent Application Publication No. 2003-71611 (Paragraphs 0023-0029)

Patent Document 4:
International Publication No. 06/005217 (page 3, line 30, to page 9, line 31).

OBJECT AND SUMMARY OF THE INVENTION

The conventional hard coating films mentioned above have the following problems. The one containing Al or Al+Si, with its maximum content (in terms of atomic ratio) being 0.75 in Patent Document 1, 0.765 in Patent Document 2, 0.9 in Patent Document 3, and 0.79 in Patent Document 4, has improved oxidation resistance. However, further improvement in oxidation resistance is required for cutting tools to be used under severer conditions.

With the recent advent of harder work materials and faster cutting speeds, there is an increasing demand for hard films with better oxidation resistance, toughness, and wear resistance than the conventional hard films made of TiAlN, TiCrAlN, TiCrAlSiBN, CrAlSiBN, NbCrAlSiBN, or the like.

The present invention was completed in view of the foregoing. It is an object of the present invention to provide a hard coating film excelling in wear resistance owing to improved hardness, oxidation resistance, and toughness, and it is another object of the present invention to provide a tool coated with said hard coating film.

The first aspect of the present invention resides in a hard coating film to be applied to the surface of a tool, said hard coating film having a composition represented by $Al_{1-a-b-c}Si_aMg_bM_c(B_xC_yN_z)$, where M denotes at least one species of elements selected from Nb, V, Zr, Cr, Ti, Cu, and Y, and a, b, c, x, y, and z represent atomic ratios such that $0 \leqq a \leqq 0.35$, $0 \leqq b \leqq 0.2$, $0.03 \leqq a+b \leqq 0.5$, $0 \leqq c \leqq 0.1$, $0.9 \leqq Al+Si+Mg$, $0 \leqq x \leqq 0.2$, $0 \leqq y \leqq 0.4$, $0.5 \leqq z \leqq 1$, and $x+y+z=1$.

The hard coating film with such a composition has improved hardness and oxidation resistance due to specific contents of specific elements.

The second aspect of the present invention resides in a hard coating film to be applied to the surface of a tool, said hard coating film being composed of layers A and layers B which are placed alternately one over another, said layer A having a composition represented by the formula $Al_{1-a-b-c}Si_aMg_bM_c(B_xC_yN_z)$, where M denotes at least one species of elements selected from Nb, V, Zr, Cr, Ti, Cu, and Y, and a, b, c, x, y, and z represent atomic ratios such that $0 \leqq a \leqq 0.35$, $0 \leqq b \leqq 0.2$, $0.03 \leqq a+b \leqq 0.5$, $0 \leqq c \leqq 0.1$, $0.9 \leqq Al+Si+Mg$, $0 \leqq x \leqq 0.2$, $0 \leqq y \leqq 0.4$, $0.5 \leqq z \leqq 1$, and $x+y+z=1$, and said layer B being composed of a compound of N, CN, BN, or BCN with at least one species of elements selected from Groups 4a, 5a, and 6a and Al, Si, and Y, and each of said layers A and layers B having a thickness not smaller than 2 nm and not larger than 200 nm.

The hard coating film specified above has improved hardness and oxidation resistance due to its multilayered structure, said layers A being composed of specific elements in specific amounts and said layers B being composed of a compound of N. CN, BN, or BCN with at least one species of elements selected from Groups 4a, 5a, and 6a and Al, Si, and Y The third aspect of the present invention resides in a modification of the hard coating film defined in the second aspect of the present invention, wherein said layer B has a composition represented by $Ti_{1-m-n}Cr_mAl_n(B_oC_pN_q)$, where m, n, o, p, and q represent atomic ratios such that $0 \leqq m \leqq 0.5$, $0.5 \leqq n \leqq 0.75$, $0 \leqq 1-m-n \leqq 0.5$, and $o+p+q=1$.

The hard coating film with such a structure has improved hardness, oxidation resistance, and toughness because layer B is composed of specific elements in specific amounts.

The fourth aspect of the present invention resides in a tool coated with any one of the hard coating films defined in the foregoing first to third aspects of the present invention.

The tool coating with the hard coating film exhibits improved hardness, oxidation resistance, and toughness owing to the hard coating film with improved hardness, oxidation resistance, and toughness.

The hard coating film according to the present invention exhibits improved hardness and oxidation resistance (and hence improved wear resistance) due to specific contents of specific elements.

Moreover, the hard coating film of layered structure (with layers A and layers B) has improved hardness and oxidation resistance as well as improved toughness, and hence it exhibits improved wear resistance. A cutting tool or hot forging jig coated with it is suitable for high-speed cutting or use under a high bearing strength.

Layers B containing specific elements in specific amounts contribute to improvement in the film's toughness, oxidation resistance, and hardness.

The hard film-coated tool according to the present invention exhibits improved hardness, oxidation resistance, toughness, and wear resistance owing to the hard coating film applied to the surface thereof which forms a hard film with improved hardness, oxidation resistance, and toughness. It also has an extended life and contributes to productivity in cutting operation.

DESCRIPTION OF THE PREFERRED EMBODIMENTS

Figure 1A:
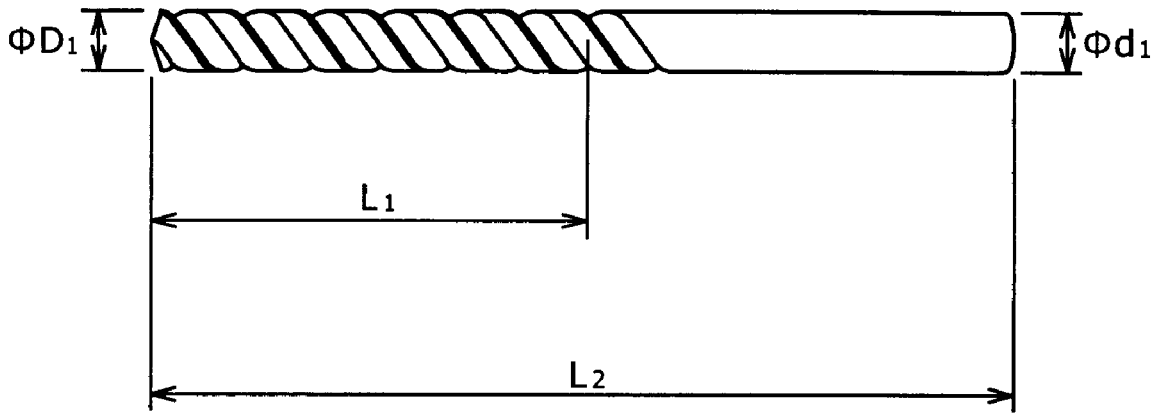
FIG. 1 is a schematic diagram showing one example of the hard film-coated tool according to the present invention. Part (a) depicts an end mill for hard materials, and part (b) depicts a copying end mill.

The following is the best mode for carrying out the present invention.

The First Embodiment

The present invention is directed to a hard coating film to be applied to the surface of a tool. The hard coating film has a composition represented by the formula $Al_{1-a-b-c}Si_aMg_bM_c(B_xC_yN_z)$, where M denotes at least one species of elements selected from Nb, V, Zr, Cr, Ti, Cu, and Y, and a, b, c, x, y, and z represent atomic ratios in specific ranges defined below (so that the content of each element is specified).

$$0.9 \leqq Al+Si+Mg$$

According to the present invention, the hard coating film (simply referred to as film hereinafter) should contain Al and Si or Mg as essential elements, so that it has good oxidation resistance as desired. The atomic ratio of Al and Si and/or Mg (denoted by "Al+(Si, Mg)" hereinafter) should be no less than 0.9. If the atomic ratio of Al+(Si, Mg) is less than 0.9, the film does not have improved oxidation resistance. Therefore, the atomic ratio of Al+(Si, Mg) should be no smaller than 0.9 and preferably no smaller than 0.95.

$$0.03 \leqq a+b \leqq 0.5$$

The atomic ratio of Al+(Si, Mg) should be larger than 0.9 and, at the same time, the atomic ratio (a+b) of Si+Mi should be no smaller than 0.03, preferably no smaller than 0.05, and no larger than 0.5, preferably no larger than 0.3. If the atomic ratio (a+b) is smaller than 0.03, the resulting film is poor in hardness and oxidation resistance. If the atomic ratio (a+b) is larger than 0.5, the resulting film is poor in hardness and toughness.

$$0 \leqq a \leqq 0.35 \text{ and } 0 \leqq b \leqq 0.2$$

The film may contain either Si or Mg as an optional element, as mentioned above.

The atomic ratio (a) of Si should be no larger than 0.35, preferably no larger than 0.3, and more preferably no larger than 0.2. The atomic ratio (b) of Mg should be no larger than 0.2, preferably no larger than 0.1. With the atomic ratios (a) and (b) larger than specified above, the resulting film is poor in hardness and toughness. Mg forms MgO upon surface oxidation, which imparts oxidation resistance and lubricity to the film.

$$0 \leqq c \leqq 0.1$$

For improved hardness and oxidation resistance, the film is incorporated with M (which is at least one species of element selected from Nb, V, Zr, Cr, Ti, Cu, and Y) in addition to Al, Si, and Mg mentioned above. Improvement in hardness and oxidation resistance varies depending on the elements incorporated.

Y improves oxidation resistance, Nb, Ti, and Zr improve hardness, and Cr and Cu improve oxidation resistance and hardness. Cu produces fine crystal grains in the film, thereby increasing the hardness of the film. Moreover, Cu remains (in metallic form) in the film without reaction with N, C, and B, so that it (as a soft metal) imparts lubricity to the film at high temperatures at the time of cutting. The atomic ratio of (c) for M should be no larger than 0.1, preferably no larger than 0.05, because an excess amount of M reduces the atomic ratio for Al+(Si, Mg), resulting in a decrease in oxidation resistance. Incidentally, M is an optional component and hence it may be omitted.

$$0 \leqq x \leqq 0.2, 0 \leqq y \leqq 0.4, 0.5 \leqq z \leqq 1, \text{ and } x+y+z=1$$

The film according to the present invention needs N as an essential component, which combines with Al and Si to form hard compounds. Therefore, the film is based on a nitride whose atomic ratio (z) is no smaller than 0.5. The film is improved in oxidation resistance by incorporation with B and is also improved in hardness by incorporation with C. If the atomic ratio of(x) for B exceeds 0.2, the resulting film is poor in hardness. Therefore, the atomic ratio for B should be no larger than 0.2, preferably no larger than 0.15. If the atomic ratio of(y) for C exceeds 0.4, the resulting film is poor in oxidation resistance. Therefore, the atomic ratio for C should be no larger than 0.4, preferably no larger than 0.2. Incidentally, B and C are optional components, and hence they may be omitted. The total of the atomic ratios for B, C, and N should be 1.

Since Si, Mg, M, B, and C are optional components as mentioned above, the hard film according to the present invention may have any one of the following compositions.

AlSiMgM(BCN), AlSiMgM(BN), AlSiMgM(CN), AlSiMgMN, AlSiM(BCN), AlSiM(BN), AlSiM(CN), AlSiMN, AlMgM(BCN), AlMgM(BN), AlMgM(CN), AlMgMN, AlSiMg(BCN), AlSiMg(BN), AlSiMg(CN), AlSiMgN, AlSi(BCN), AlSi(BN), AlSi(CN), AlSiN, AlMg(BCN), AlMg(BN), AlMg(CN), and AlMgN.

The Second Embodiment

The second embodiment of the present invention will be described in the following.

The present invention is directed to a hard coating film to be applied to the surface of a tool, said hard coating film being composed of layers A and layers B which are placed alternately one over another, said layer A having a composition represented by $Al_{1-a-b-c}Si_aMg_bM_c(B_xC_yN_z)$ where M denotes at least one species of elements selected from Nb, V, Zr, Cr, Ti, Cu, and Y, and a, b, c, x, y, and z represent specific atomic ratios and said layer B being composed of a compound of N, CN, BN, or BCN with at least one species of elements selected from Groups 4a, 5a, and 6a and Al, Si, and Y, and each of said layers A and layers B having a thickness not smaller than 2 nm and not larger than 200 nm.

The film of AlSiMgM(BCN) or the like according to the first embodiment of the present invention can be applied as such to the sliding part of a tool for improvement in wear resistance at high temperatures. However, the hard coating film exhibits better oxidation resistance and hardness as well as better toughness when it has a multilayered structure composed of layers A and layers B, the former being made of AlSiMgM(BCN) and the latter being made of a compound of N, CN, BN, or BCN with at least one species of elements selected from Groups 4a, 5b, and 6a and Al, Si, and Y. The film of layered structure can be applied to cutting of hard materials and hot forging with a high bearing strength.

The foregoing composition and thickness for layers A and layers B are defined for the following reasons.

Layer A

Layer A has a composition represented by the formula $Al_{1-a-b-c}Si_aMg_bM_c(B_xC_yN_z)$, where M denotes at least one species of elements selected from Nb, V, Zr, Cr, Ti, Cu, and Y, and a, b, c, x, y, and z represent atomic ratios such that $0 \leqq a \leqq 0.35$, $0 \leqq b \leqq 0.2$, $0.03 \leqq a+b \leqq 0.5$, $0 \leqq c \leqq 0.1$, $0.9 \leqq Al+Si+Mg$, $0 \leqq x \leqq 0.2$, $0 \leqq y \leqq 0.4$, $0.5 \leqq z \leqq 1$, and $x+y+z=1$.

The composition of layer A is defined as above for the same reason as explained above for the hard coating film according to the first embodiment of the present invention. Therefore, the explanation for the reason is not repeated.

Layer B

Layer B is composed of a compound of N, CN, BN, or BCN with at least one species of elements selected from Groups 4a, 5a, and 6a and Al, Si, and Y. Examples of such compounds include Ti(BCN), Cr(BCN), TiAl(BCN), TiCrAl(BCN), AlCr(BCN), TiCrAlY(BCN), NbAl(BCN), and NbCrAl (BCN). They are merely exemplary. The parenthesized BCN represents any of N, CN, BN, and BCN. Of these compounds, the one containing Al with an atomic ratio larger than 0.5 is desirable from the standpoint of oxidation resistance and hardness.

Thickness of layers A and layers B: no smaller than 2 nm and no larger than 200 nm Each of layers A and layers B constituting the hard coating film should have a thickness no smaller than 2 nm and no larger than 200 nm. If each layer has a thickness smaller than 2 nm, the resulting film is poor in toughness. Therefore, each layer should have a thickness no smaller than 2 nm, preferably no smaller than 5 nm. On the other hand, if each layer has a thickness larger than 200 nm, the film of layered structure is poor in toughness. Therefore, each layer should have a thickness no larger than 200 nm, preferably no larger than 100 nm.

Layer B is composed of a compound of N, CN, BN, or BCN with at least one species of elements selected from Groups 4a, 5a, and 6a and Al, Si, and Y, and it should have a composition represented by $Ti_{1-m-n}Cr_mAl_n(B_oC_pN_q)$, where m, n, o, p, and q represent atomic ratios such that 0 μm≦0.5, $0.5 \leqq n \leqq 0.75$, $0 \leqq 1-m-n \leqq 0.5$, and $o+p+q=1$.

Examples of the compound include TiCrAl(BCN), CrAl (BCN), TiAl(BCN), etc. The atomic ratio (n) for Al should be no larger than 0.5 and no smaller than 0.75, and the atomic ratios (m) and (1−m−n) for Cr and Ti, respectively, should be no larger than 0.5. Incidentally, Cr and Ti are optional components and they may be omitted. N is an essential component to form a hard compound. B and C are optional components, and they may be omitted.

The foregoing composition for layers B is defined for the following reasons.

$$0.5 \leqq n \leqq 0.75$$

Layers B should be formed from a compound not containing Si and Mg (which have an adverse effect on toughness). Moreover, layers B impart high toughness to the film of layered structure when the atomic ratio (n) for Al is no larger than 0.7. On the other hand, if the atomic ratio for Al is smaller than 0.5, the resulting film (combined with layers A having high oxidation resistance) is poor in oxidation resistance. Therefore, the atomic ratio for Al should be no smaller than 0.5, preferably no smaller than 0.6, and no larger than 0.75, preferably no larger than 0.7.

$$0 \leqq m \leqq 0.5 \text{ and } 0 \leqq 1-m-n \leqq 0.5$$

Either or both of Cr and Ti may be added according to the intended object. Cr added alone will contribute to oxidation resistance, and Ti added alone will contribute to hardness. Cr and Ti added together will improve oxidation resistance and hardness.

When Cr is added alone, the atomic ratio (m) for Cr should be no smaller than 0.25 and no larger than 0.5. Cr with an atomic ratio smaller than 0.25 causes the crystal structure of the film to transform into the hexagonal sys-tem, which is poor in hardness and oxidation resistance. If the atomic ratio for Cr is larger than 0.5, the atomic ratio for Al decreases and the resulting film is poor in oxidation resistance. Incidentally, the atomic ratio for Cr should preferably be no smaller than 0.3 and no larger than 0.4.

When Ti is added alone, the atomic ratio (1−m−n) for Ti should be no smaller than 0.3 and no larger than 0.5. Ti with an atomic ratio smaller than 0.3 causes the crystal structure of the film to transform into the hexagonal sys-tem, which is poor in hardness. If the atomic ratio for Ti is larger than 0.5, the atomic ratio for Al decreases and the resulting film is poor in oxidation resistance. Incidentally, the atomic ratio for Ti should preferably be no smaller than 0.35 and no larger than 0.4.

When both Ti and Cr are added, their atomic ratio should be no smaller than 0.05, preferably no smaller than 0.1, so that the resulting film has oxidation resistance and hardness as desired. The atomic ratio for Cr+Ti should be no smaller than 0.5. If the atomic ratio for Cr+Ti exceeds this limit, the atomic ratio for Al decreases and the resulting film is poor in oxidation resistance.

$$o+p+q=1$$

The total of the atomic ratios of B, C, and N should be 1. Incidentally, B contributes to oxidation resistance and C contributes to hardness.

Since Ti, Cr, B, and C are optional components as mentioned above, layers B may have any one of the following compositions. TiCrAl(BCN), TiCrAl(BN), TiCrAl(CN), TiCrAlN, CrAl(BCN), CrAl(BN), CrAl(CN), CrAlN, TiAl (BCN), TiAl(BN), TiAl(CN), and TiAlN.

The hard film-coated tool according to the present invention will be described below with reference to accompanying drawings. The hard film-coated tool is a tool having a hard film coated thereon. The hard film is the one mentioned above which accords with the present invention.

Figure 1B:
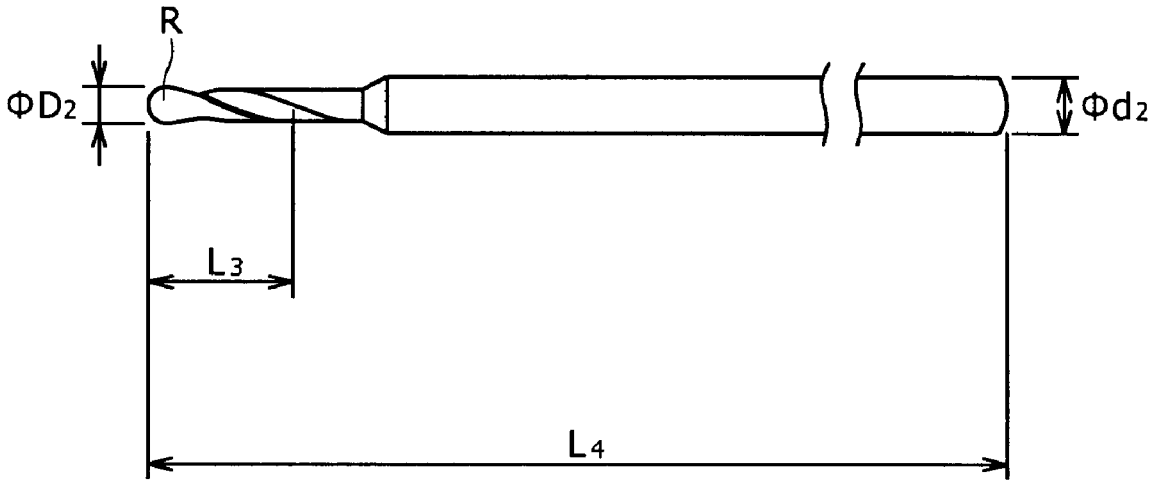

FIG. 1 is a schematic diagram showing one example of the hard film-coated tool according to the present invention. Part (a) depicts an end mill for hard materials, and part (b) depicts a copying end mill.

An example of the hard film-coated tool shown in Part (a) of FIG. 1 is an end mill for hard materials, which has a diameter ($D_1$) of 10.0 mm at its tip, a diameter ($d_1$) of 10.0 mm at its shank, a blade length ($L_1$) of 50 mm, and a total length ($L_2$) of 100 mm. Another example of the hard film-coated tool shown in Part (b) of FIG. 1 is a copying end mill, which has a diameter ($D_2$) of 6.0 mm at its tip, a diameter ($d_2$) of 6.0 mm at its shank, a radius (R) of 3.0 mm for its end ball, a blade length ($L_3$) of 9 mm, and a total length ($L_5$) of 250 mm. They are merely exemplary.

Tools onto which the hard coating film is applied include cutting tools, such as end mills (mentioned above), chips, and drills, and jigs, such as presses, forging dies, and punching dies. They are merely exemplary, and they also include any other tools. The hard coating film on the tool may be formed by arc ion plating or unbalanced magnetron sputtering. They are merely exemplary.

An example of the method for coating tools is described below. Any other method is also available.

The method employs an apparatus equipped with more than one evaporation source of arc type and sputter type. The cathode of the apparatus is provided with a target of metal or alloy. An end mill (or any other substrate to be coated) is placed on the support of the rotating substrate stage. Then, the chamber is evacuated. The substrate is heated to 550° C. by a heater installed in the chamber. The chamber is supplied with nitrogen gas (or $N_2$—$CH_4$ mixture for C-containing film), with the pressure in the chamber kept at 4 Pa. Under this condition, coating film is formed on the surface of the substrate by arc discharging. In the case where the evaporation sources of both arc type and sputter type are used, the chamber is supplied with a mixed gas of Ar—$N_2$ (or Ar—$N_2$—$CH_4$) in 1:1 by volume, with the total pressure kept at 2.8 Pa, and both of the evaporation sources are caused to discharge simultaneously. A bias voltage of −100 V is applied to the substrate.

Coating with the hard film having improved hardness, oxidation resistance, and toughness makes the tool to improve in hardness, oxidation resistance, toughness, and wear resistance. The thus coated tool contributes to productivity in cutting operation.

EXAMPLES

The invention will be described in more detail with reference to the following examples, which are not intended to restrict the scope thereof but may be modified within the scope thereof.

Figure 2:
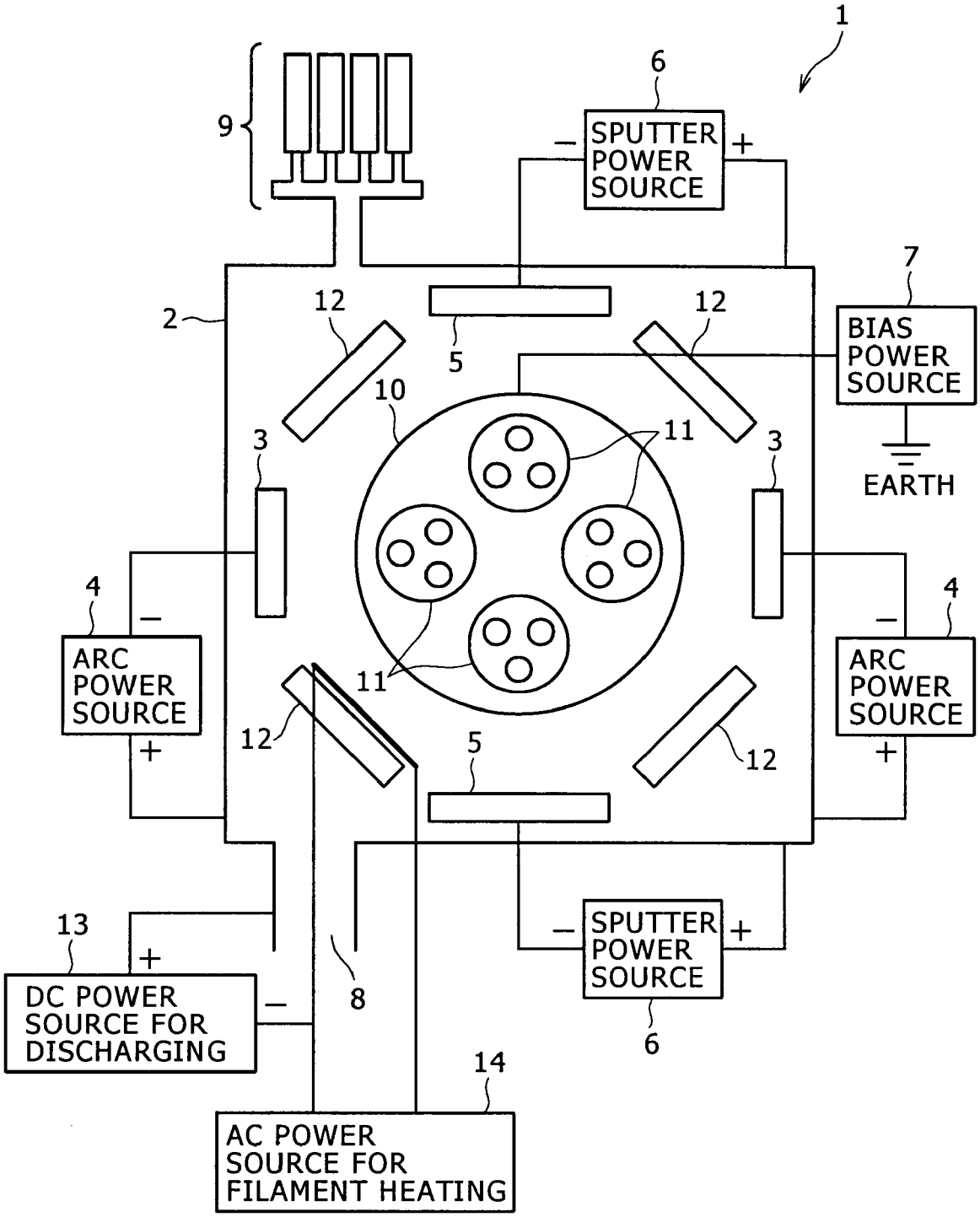
FIG. 2 is a schematic diagram showing the film forming apparatus used in the example of the present invention.

FIG. 2 is a schematic diagram showing the film forming apparatus used in the example of the present invention.

The film-forming apparatus 1 is comprised of a chamber 2 (which has an exhaust port 8 for evacuation and a gas supply port 9), an arc power source 4 (which is connected to an arc evaporation source 3), a sputter power source 6 (which is connected to a sputter evaporation source 5), supporters 11 on a substrate stage 10 (which are so designed as to hold substrates (not shown), such as cutting tools, to be coated, and a bias power source 7 (which applies a negative bias voltage across the supporters 11 and the chamber 2). It also has a heater 1, a DC power source 13 for discharging, and an AC power source 14 for filament heating. The chamber is supplied with a film-forming gas (such as nitrogen ($N_2$) and methane ($CH_4$)) and a rare gas (such as argon). Selection of the film-forming gas depends on the film to be formed.

Incidentally, the evaporation source 3 of arc type affords arc ion plating evaporation (AIP) and the evaporation source 5 for sputtering affords unbalanced magnetron sputtering evaporation (UBM).

Example 1

This example was carried out by using the film-forming apparatus 1 (shown in FIG. 2) which has more than one evaporation sources (evaporation sources 3 of arc type and evaporation sources 5 of sputter type). The cathode of the apparatus 1 is provided with a target (not shown) of metal or alloy. The supporters 11 on the rotating substrate stage 10 are provided with substrates (not shown) to be coated. The substrates are a chip of cemented carbide, end mill for test cutting of cemented carbide (having 6 blades and a diameter of 10 mm at tip), and platinum foil (30 mm long, 5 mm wide, and 0.1 mm thick). First, the chamber 2 was evacuated, and then the substrate was heated to 550° C. by means of the heater 12 in the chamber 2. The chamber 2 was supplied with nitrogen gas (or $N_2$—$CH_4$ mixed gas for a C-containing film). With the pressure in the chamber 2 kept at 4 Pa, arc discharging was started, so that coating films (about 3 μm thick), shown in Tables 1 and 2, were formed on the substrates. A bias voltage of −100 V was applied to the substrates.

In Example 1, arc ion plating evaporation (AIP) was carried out by using the evaporation source 3 of arc type.

The resulting coating film was examined for metal composition as well as hardness, oxidation resistance, and wear resistance in the following manner.

Film Composition

The coating film on the chip of cemented carbide was examined for metal composition by means of an EPMA (Electron Probe Micro Analyzer).

Hardness

The coating film on the chip of cemented carbide was examined for hardness by means of a Vickers hardness tester under a load of 0.25 N and for duration of 15 seconds. The samples were rated as good or poor depending on their hardness higher than 20 GPa or lower than 20 GPa.

Oxidation Resistance

The coating film was examined for oxidation resistance by determining the temperature at which oxidation started. This determination was carried out by measuring (with a thermobalance) the weight change that occurred when the sample (the coating film on the platinum foil) was heated in dry air at a rate of 4° C./min. The higher the oxidation starting temperature, the better the sample is in oxidation resistance because of its low reactivity with the substrate. The samples were rated as good or poor in oxidation resistance depending on their oxidation starting temperature higher than 1050° C. or lower than 1050° C.

Wear Resistance

The hard coating film formed on the end mill was examined for wear resistance by performing cutting tests under the following conditions. Wear resistance was expressed in terms of the amount of wear (wear width) on the blade flank. The smaller the amount of wear (wear width), the better the wear resistance. The samples were rated as good or poor in wear resistance depending on the amount of wear less than 100 μm or more than 100 μm.

Conditions of Cutting Test

Work piece: SKD11 (HRC60)

Cutting speed: 150 m/min

Feed: 0.04 mm/blade

Axial cutting: 4.5 mm

Radial cutting: 0.2 mm

Cutting length: 50 m

Others: down cut, dry cut, and air blow only

The results in Example 1 are shown in Tables 1 and 2. Incidentally, the symbol "–" in the column of "Kind of M" indicates that the sample does not contain M.

TABLE 1

Results of Evaluation in Example 1

| No. | Film composition (atomic ratio) Al | Si | Mg | Si + Mg | Kind of M | M | B | C | N | Hardness (GPa) | Oxidation resistance Oxidation starting temperature (° C.) | Wear resistance Amount of wear (μm) | Remarks |
|---|---|---|---|---|---|---|---|---|---|---|---|---|---|
| 1 | | | | | TiN | | | | | 22 | 600 | 215 | |
| 2 | | | | | Ti0.5Al0.5N | | | | | 25 | 800 | 150 | |
| 3 | | | | | Ti0.5Al0.45Si0.05N | | | | | 27 | 850 | 127.5 | |
| 4 | 0.97 | 0.03 | 0 | 0.03 | — | 0 | 0 | 0 | 1 | 20 | 1130 | 92.5 | Effect of amount of Si |
| 5 | 0.95 | 0.05 | 0 | 0.05 | — | 0 | 0 | 0 | 1 | 21 | 1150 | 82.5 | |
| 6 | 0.9 | 0.1 | 0 | 0.1 | — | 0 | 0 | 0 | 1 | 26 | 1170 | 52.5 | |
| 7 | 0.8 | 0.2 | 0 | 0.2 | — | 0 | 0 | 0 | 1 | 23 | 1200 | 60 | |
| 8 | 0.65 | 0.35 | 0 | 0.35 | — | 0 | 0 | 0 | 1 | 20 | 1250 | 62.5 | |
| 9 | 1 | 0 | 0 | 0 | — | 0 | 0 | 0 | 1 | 18 | 1000 | 135 | |
| 10 | 0.99 | 0.01 | 0 | 0.01 | — | 0 | 0 | 0 | 1 | 18 | 1000 | 135 | |
| 11 | 0.6 | 0.4 | 0 | 0.4 | — | 0 | 0 | 0 | 1 | 11 | 1250 | 107.5 | |
| 12 | 0.97 | 0 | 0.03 | 0.03 | — | 0 | 0 | 0 | 1 | 23 | 1080 | 90 | Effect of amount of Mg |
| 13 | 0.95 | 0 | 0.05 | 0.05 | — | 0 | 0 | 0 | 1 | 27 | 1150 | 52.5 | |
| 14 | 0.9 | 0 | 0.1 | 0.1 | — | 0 | 0 | 0 | 1 | 26 | 1150 | 57.5 | |
| 15 | 0.85 | 0 | 0.15 | 0.15 | — | 0 | 0 | 0 | 1 | 23 | 1190 | 62.5 | |
| 16 | 0.8 | 0 | 0.2 | 0.2 | — | 0 | 0 | 0 | 1 | 21 | 1200 | 70 | |
| 17 | 0.99 | 0 | 0.01 | 0.01 | — | 0 | 0 | 0 | 1 | 18 | 1000 | 135 | |
| 18 | 0.75 | 0 | 0.25 | 0.25 | — | 0 | 0 | 0 | 1 | 13 | 1200 | 110 | |
| 19 | 0.9 | 0.02 | 0.08 | 0.1 | — | 0 | 0 | 0 | 1 | 25 | 1100 | 75 | Effect of ratio of Si:Mg |
| 20 | 0.9 | 0.05 | 0.05 | 0.1 | — | 0 | 0 | 0 | 1 | 24 | 1200 | 55 | |
| 21 | 0.9 | 0.07 | 0.03 | 0.1 | — | 0 | 0 | 0 | 1 | 23 | 1250 | 47.5 | |
| 22 | 0.9 | 0.08 | 0.02 | 0.1 | — | 0 | 0 | 0 | 1 | 22 | 1300 | 40 | |
| 23 | 0.94 | 0.03 | 0.03 | 0.06 | — | 0 | 0 | 0 | 1 | 24 | 1150 | 67.5 | Effect of amount of |
| 24 | 0.84 | 0.08 | 0.08 | 0.16 | — | 0 | 0 | 0 | 1 | 27 | 1200 | 40 | Si + Mg |
| 25 | 0.7 | 0.15 | 0.15 | 0.3 | — | 0 | 0 | 0 | 1 | 24 | 1250 | 42.5 | |
| 26 | 0.5 | 0.3 | 0.2 | 0.5 | — | 0 | 0 | 0 | 1 | 20 | 1300 | 50 | |
| 27 | 0.98 | 0.01 | 0.01 | 0.02 | — | 0 | 0 | 0 | 1 | 18 | 1000 | 135 | |
| 28 | 0.45 | 0.35 | 0.2 | 0.55 | — | 0 | 0 | 0 | 1 | 13 | 1200 | 110 | |

TABLE 2

Results of Evaluation in Example 1

| No. | Film composition (atomic ratio) Al | Si | Mg | Si + Mg | Kind of M | M | B | C | N | Hardness (GPa) | Oxidation starting temperature (° C.) | Wear resistance Amount of wear (μm) | Remarks |
|---|---|---|---|---|---|---|---|---|---|---|---|---|---|
| 29 | 0.88 | 0.1 | 0 | 0.1 | Cr | 0.02 | 0 | 0 | 1 | 25 | 1150 | 62.5 | Effect of M amount |
| 30 | 0.85 | 0.1 | 0 | 0.1 | Cr | 0.05 | 0 | 0 | 1 | 27 | 1200 | 40 | |
| 31 | 0.82 | 0.1 | 0 | 0.1 | Cr | 0.08 | 0 | 0 | 1 | 28 | 1150 | 47.5 | |
| 32 | 0.8 | 0.1 | 0 | 0.1 | Cr | 0.1 | 0 | 0 | 1 | 28 | 1150 | 47.5 | |
| 33 | 0.7 | 0.1 | 0 | 0.1 | Cr | 0.2 | 0 | 0 | 1 | 20 | 950 | 137.5 | |
| 34 | 0.8 | 0.1 | 0.05 | 0.15 | Nb | 0.05 | 0 | 0 | 1 | 30 | 1170 | 32.5 | Effect of kind of M |
| 35 | 0.8 | 0.1 | 0.05 | 0.15 | Cr | 0.05 | 0 | 0 | 1 | 29 | 1200 | 30 | |
| 36 | 0.8 | 0.1 | 0.05 | 0.15 | Ti | 0.05 | 0 | 0 | 1 | 30 | 1150 | 37.5 | |
| 37 | 0.8 | 0.1 | 0.05 | 0.15 | Cu | 0.05 | 0 | 0 | 1 | 32 | 1200 | 15 | |
| 38 | 0.8 | 0.1 | 0.05 | 0.15 | Y | 0.05 | 0 | 0 | 1 | 24 | 1250 | 42.5 | |
| 39 | 0.8 | 0.1 | 0.05 | 0.15 | V | 0.05 | 0 | 0 | 1 | 28 | 1150 | 47.5 | |
| 40 | 0.8 | 0.1 | 0.05 | 0.15 | Zr | 0.05 | 0 | 0 | 1 | 27 | 1200 | 40 | |
| 41 | 0.8 | 0.1 | 0.05 | 0.15 | Cr, Ti | 0.05 | 0 | 0 | 1 | 30 | 1150 | 37.5 | |
| 42 | 0.8 | 0.1 | 0.05 | 0.15 | Cu, Y | 0.05 | 0 | 0 | 1 | 30 | 1230 | 17.5 | |
| 43 | 0.95 | 0 | 0.05 | 0.05 | — | 0 | 0.05 | 0 | 0.95 | 26 | 1150 | 57.5 | Effect of amount of B |
| 44 | 0.95 | 0 | 0.05 | 0.05 | — | 0 | 0.1 | 0 | 0.9 | 28 | 1170 | 42.5 | |
| 45 | 0.95 | 0 | 0.05 | 0.05 | — | 0 | 0.15 | 0 | 0.85 | 26 | 1200 | 45 | |
| 46 | 0.95 | 0 | 0.05 | 0.05 | — | 0 | 0.2 | 0 | 0.8 | 25 | 1200 | 50 | |
| 47 | 0.95 | 0 | 0.05 | 0.05 | — | 0 | 0.25 | 0 | 0.75 | 15 | 1150 | 112.5 | |
| 48 | 0.95 | 0 | 0.05 | 0.05 | — | 0 | 0 | 0.1 | 0.9 | 30 | 1150 | 37.5 | Effect of amount of C |
| 49 | 0.9 | 0.05 | 0.05 | 0.1 | — | 0 | 0 | 0.2 | 0.8 | 31 | 1130 | 37.5 | |
| 50 | 0.9 | 0.05 | 0.05 | 0.1 | — | 0 | 0 | 0.4 | 0.6 | 29 | 1100 | 55 | |
| 51 | 0.9 | 0.05 | 0.05 | 0.1 | — | 0 | 0 | 0.5 | 0.5 | 24 | 1000 | 105 | |
| 52 | 0.9 | 0.05 | 0.05 | 0.1 | — | 0 | 0.1 | 0.2 | 0.7 | 29 | 1170 | 37.5 | Effect of amount of B + C |
| 53 | 0.9 | 0.05 | 0.05 | 0.1 | — | 0 | 0.2 | 0.1 | 0.7 | 29 | 1200 | 30 | |
| 54 | 0.9 | 0.05 | 0.05 | 0.1 | — | 0 | 0.05 | 0.25 | 0.7 | 30 | 1150 | 37.5 | |
| 55 | 0.9 | 0.05 | 0.05 | 0.1 | | 0 | 0.2 | 0.35 | 0.45 | 18 | 1100 | 110 | Effect of amount of N |

As shown in Tables 1 and 2, the samples Nos. 4-8, 12-16, 19-26, 29-32, 34-36, 48-50, and 52-54 are superior in hardness, oxidation resistance, and wear resistance because they have the composition meeting the requirement of the present invention.

By contrast, the samples Nos. 1-3 are poor in oxidation resistance and wear resistance despite their good hardness because they are of conventional type (based on TiN, TiAlN, and TiAlSiN). The samples Nos. 9, 10, 17, and 27 are poor in hardness and oxidation resistance and hence wear resistance because they have an atomic ratio (Si+Mg) smaller than the lower limit. The sample No. 28 is poor in hardness and wear resistance because it has an atomic ratio (Si+Mg) larger than the upper limit.

The samples Nos. 11 and 18 are poor in hardness and wear resistance because their atomic ratio for Si and Mg are higher than the upper limit. The sample No. 33 is poor in oxidation resistance and hence wear resistance because its atomic ratio for M(Cr) is higher than the upper limit. The sample No. 47 is poor in hardness and hence in wear resistance because its atomic ratio for B is higher than the upper limit. The sample No. 51 is poor in oxidation resistance and hence in wear resistance because its atomic ratio of C is higher than the upper limit. The sample No. 55 is poor in hardness and hence in wear resistance because its atomic ratio for N is smaller than the lower limit.

Example 2

This example was carried out by using the film-forming apparatus 1 (shown in FIG. 2) which has more than one evaporation sources (evaporation sources 3 of arc type and evaporation sources 5 of sputter type). The cathode of the apparatus 1 is provided with a target (not shown) of metal or alloy. The supporters 11 on the rotating substrate stage 10 are provided with substrates (not shown) to be coated. The substrates are a chip of cemented carbide, end mill for test cutting of cemented carbide (having 6 blades and a diameter of 10 mm at tip), and platinum foil (30 mm long, 5 mm wide, and 0.1 mm thick). First, the chamber 2 was evacuated, and then the substrate was heated to 550° C. by means of the heater 12 in the chamber 2. The chamber 2 was supplied with nitrogen gas (or $N_2$—$CH_4$ mixed gas for a C-containing film). With the pressure in the chamber 2 kept at 4 Pa, arc discharging was started, so that layers A and layers B of coating films were formed alternately on the substrates. The thickness of each layer and the total thickness of layers A and layers B are shown in Table 3. In the case where both the evaporation source 3 of arc type and the evaporation source 5 of sputter type are used at the same time, the chamber was supplied with a mixed gas of Ar—$N_2$ (or Ar—$N_2$—$CH_4$) in 1:1 by volume. The total pressure was kept at 2.8 Pa. Both of the evaporation sources were allowed to discharge simultaneously. A bias voltage of −100 V was applied to the substrates.

To form the layered film, the evaporation sources were provided with targets differing in composition and the substrates were placed on the rotating support 11. The substrates were turned while the layered film was being formed. As the substrate stage 10 turns, the substrates held on the support 11 turning together with the substrate stage 10 pass by the evaporation sources (each provided with a target of different composition). Each time the substrate passes by the evaporation source, a layer of film corresponding to the target composition is formed. In this way the layered film was formed. The thickness of each of layers A and layers B was controlled by regulating the electric power (for the amount of evaporation) applied to each evaporation source or by regulating the speed of rotation of the support 11 (the faster the rotation, the smaller the thickness of each layer). In this way layers A and layers B were formed alternately one over another.

The resulting coating film was examined for metal composition as well as toughness, oxidation resistance, and wear resistance in the following manner.

Film Composition

The coating film on the chip of cemented carbide was examined for metal composition by means of an EPMA (Electron Probe Micro Analyzer).

Toughness

The coating film on the chip of cemented carbide was examined for toughness by scratching with a diamond stylus (having a tip radius of 200 μm) under a load of 0 to 100 N (which was increased at a rate of 100 N/min) over a distance of 10 mm. The load large enough to cause chipping to the film was defined as the chipping load (N). The film was rated as good or poor in toughness depending on the chipping load higher than 80 N or lower than 80 N.

Oxidation Resistance

The coating film was examined for oxidation resistance by determining the temperature at which oxidation started. This determination was carried out by measuring (with a thermobalance) the weight change that occurred when the sample (the coating film on the platinum foil) was heated in dry air at a rate of 4° C./min. The higher the oxidation starting temperature, the better the sample is in oxidation resistance because of its low reactivity with the substrate. The samples were rated as good or poor in oxidation resistance depending on their oxidation starting temperature higher than 1100° C. or lower than 1100° C.

Wear Resistance

The hard coating film formed on the end mill was examined for wear resistance by performing cutting tests under the following conditions. Wear resistance was expressed in terms of the amount of wear (wear width) on the blade flank. The smaller the amount of wear (wear width), the better the wear resistance. The samples were rated as good, fair, or poor in wear resistance depending on the amount of wear less than 85 μm, from 85 to 100 μm, or more than 110 μm.

The work piece used in Example 2 is harder than that used in Example 1.

Conditions of Cutting Test

Work piece: SKH51 (HRC65)
Cutting speed: 100 m/min (3183 rpm)
Cutting depth: 5 mm
Axial cutting: 0.2 mm
Feed: 0.1 mm/blade (1909 mm/min)
Down cut, with air blow only
Cutting length: 10 m
Others: down cut, dry cut, and air blow only The results in Example 2 are shown in Table 3. Incidentally, the symbol "–" in the table indicates that the sample does not contain layers B. AIP stands for arc ion plating evaporation and UBM stands for unbalanced magnetron sputtering evaporation. "Hardness" in the table denotes the Vickers hardness of the film on chip of cemented carbide which was measured under a load of 0.25 N for 15 seconds. The measured Vickers hardness is an average for the layered film.

TABLE 3

Results of Evaluation in Example 2

| No. | Composition of layers B | Thickness (nm) | Evaporation source | Composition of layers A | Thickness (nm) | Evaporation source |
|---|---|---|---|---|---|---|
| 1 | — | — | — | (Ti0.5Al0.5)N | 3000 | AIP |
| 2 | — | — | — | (Ti0.5Al0.47Si0.03)N | 3000 | AIP |
| 3 | (Ti0.2Cr0.15Al0.65)N | 300 | AIP | (Al0.9Si0.05Mg0.05)N | 300 | AIP |
| 4 | (Ti0.2Cr0.15Al0.65)N | 1 | AIP | (Al0.9Si0.05Mg0.05)N | 1 | AIP |
| 5 | — | — | — | (Al0.9Si0.1)N | 3000 | AIP |
| 6 | — | — | — | (Al0.9Si0.05Mg0.05)N | 3000 | AIP |
| 7 | — | — | — | (Al0.87Si0.1Cu0.03)N | 3000 | AIP |
| 8 | TiN | 20 | AIP | (Al0.88Si0.1Cu0.02)N | 20 | AIP |
| 9 | (Ti0.2Nb0.2Al0.6)N | 20 | AIP | (Al0.88Si0.1Cu0.02)N | 20 | AIP |
| 10 | CrN | 20 | AIP | (Al0.88Si0.1Cu0.02)N | 20 | AIP |
| 11 | (Cr0.2Nb0.2Al0.6)N | 20 | AIP | (Al0.88Si0.1Cu0.02)N | 20 | AIP |
| 12 | NbN | 20 | AIP | (Al0.88Si0.1Cu0.02)N | 20 | AIP |
| 13 | (Nb0.5Al0.5)N | 20 | AIP | (Al0.88Si0.1Cu0.02)N | 20 | AIP |
| 14 | (Ti0.75Al0.25)N | 50 | AIP | (Al0.9Si0.1)N | 20 | AIP |
| 15 | (Ti0.15Al0.85)N | 50 | AIP | (Al0.9Si0.1)N | 20 | AIP |
| 16 | (Ti0.2Al0.3Cr0.5)N | 50 | AIP | (Al0.88Si0.1Cu0.02)N | 20 | AIP |
| 17 | (Ti0.5Al0.3Cr0.2)N | 50 | AIP | (Al0.88Si0.1Cu0.02)N | 20 | AIP |
| 18 | (Ti0.5Al0.5)N | 20 | AIP | (Al0.88Si0.1Cu0.02)N | 20 | AIP |
| 19 | (Ti0.5Al0.5)N | 50 | AIP | (Al0.9Si0.1)N | 20 | AIP |
| 20 | (Ti0.34Al0.66)N | 50 | AIP | (Al0.9Si0.1)N | 20 | AIP |
| 21 | (Cr0.4Al0.6)N | 20 | AIP | (Al0.93Si0.05Y0.02)N | 20 | UBM |
| 22 | (Cr0.4Al0.6)N | 20 | AIP | (Al0.9Si0.05Cr0.05)N | 20 | UBM |
| 23 | (Cr0.4Al0.6)N | 20 | AIP | (Al0.9Si0.05Ti0.05)N | 20 | UBM |
| 24 | (Cr0.4Al0.6)N | 20 | AIP | (Al0.9Si0.05Nb0.05)N | 20 | UBM |
| 25 | (Cr0.4Al0.6)N | 20 | AIP | (Al0.88Si0.1Cu0.02)N | 20 | AIP |
| 26 | (Ti0.2Cr0.15Al0.65)N | 2 | AIP | (Al0.9Si0.05Mg0.05)N | 2 | AIP |
| 27 | (Ti0.2Cr0.15Al0.65)N | 10 | AIP | (Al0.9Si0.05Mg0.05)N | 10 | AIP |
| 28 | (Ti0.2Cr0.15Al0.65)N | 20 | AIP | (Al0.9Si0.05Mg0.05)N | 20 | AIP |
| 29 | (Ti0.2Cr0.15Al0.65)N | 50 | AIP | (Al0.9Si0.05Mg0.05)N | 50 | AIP |
| 30 | (Ti0.2Cr0.15Al0.65)N | 100 | AIP | (Al0.9Si0.05Mg0.05)N | 100 | AIP |
| 31 | (Ti0.2Cr0.15Al0.65)N | 20 | AIP | (Al0.75Si0.2Mg0.05)N | 20 | AIP |
| 32 | (Ti0.2Cr0.15Al0.65)N | 20 | AIP | (Al0.65Si0.3Mg0.05)N | 20 | AIP |
| 33 | (Ti0.1Al0.7Cr0.2)N | 50 | AIP | (Al0.88Si0.1Cu0.02)N | 20 | AIP |
| 34 | (Ti0.2Cr0.15Al0.65)N | 30 | AIP | (Al0.9Si0.05Mg0.05)N | 30 | UBM |
| 35 | (Ti0.2Cr0.15Al0.65)C0.2N0.8 | 30 | AIP | (Al0.8Si0.15Mg0.05)N | 30 | UBM |
| 36 | (Ti0.2Cr0.15Al0.65)B0.1N0.9 | 30 | AIP | (Al0.8Si0.15Mg0.05)N | 30 | UBM |
| 37 | (Ti0.2Cr0.15Al0.65)B0.05C0.1N0.85 | 30 | AIP | (Al0.8Si0.15Mg0.05)N | 30 | UBM |
| 38 | (Ti0.2Cr0.15Al0.65)N | 200 | AIP | (Al0.9Si0.05Mg0.05)N | 200 | AIP |
| 39 | (Ti0.2Al0.5Cr0.3)N | 50 | AIP | (Al0.88Si0.1Cu0.02)N | 20 | AIP |

| No. | Cycle of lamination (nm) | Number of layers | Total thickness (nm) | Hardness (GPa) | Toughness Chipping load (N) | Oxidation resistance Oxidation starting temperature (° C.) | Wear resistance Amount of wear (μm) |
|---|---|---|---|---|---|---|---|
| 1 | — | 1 | 3000 | 25 | 60 | 800 | 245 |
| 2 | — | 1 | 3000 | 27 | 75 | 850 | 187.5 |
| 3 | 600 | 5 | 3000 | 33 | 75 | 1100 | 125 |
| 4 | 2 | 1500 | 3000 | 25 | 75 | 1100 | 125 |
| 5 | — | 1 | 3000 | 23 | 75 | 1170 | 107.5 |
| 6 | — | 1 | 3000 | 24 | 75 | 1200 | 100 |
| 7 | — | 1 | 3000 | 32 | 75 | 1250 | 87.5 |
| 8 | 40 | 75 | 3000 | 35 | 85 | 1150 | 82.5 |
| 9 | 40 | 75 | 3000 | 33 | 100 | 1250 | 12.5 |
| 10 | 40 | 75 | 3000 | 33 | 85 | 1200 | 70 |
| 11 | 40 | 75 | 3000 | 35 | 100 | 1250 | 12.5 |
| 12 | 40 | 75 | 3000 | 38 | 90 | 1200 | 55 |
| 13 | 40 | 75 | 3000 | 37 | 100 | 1250 | 12.5 |
| 14 | 70 | 42 | 2940 | 35 | 85 | 1170 | 77.5 |
| 15 | 70 | 42 | 2940 | 34 | 85 | 1250 | 57.5 |
| 16 | 70 | 42 | 2940 | 34 | 90 | 1200 | 55 |
| 17 | 70 | 42 | 2940 | 34 | 85 | 1150 | 82.5 |
| 18 | 40 | 75 | 3000 | 36 | 90 | 1200 | 55 |
| 19 | 70 | 42 | 2940 | 36 | 90 | 1200 | 55 |
| 20 | 70 | 42 | 2940 | 37 | 95 | 1250 | 27.5 |
| 21 | 40 | 75 | 3000 | 36 | 95 | 1200 | 40 |
| 22 | 40 | 75 | 3000 | 37 | 95 | 1150 | 52.5 |
| 23 | 40 | 75 | 3000 | 35 | 90 | 1200 | 55 |
| 24 | 40 | 75 | 3000 | 36 | 95 | 1250 | 27.5 |
| 25 | 40 | 75 | 3000 | 35 | 100 | 1250 | 12.5 |
| 26 | 4 | 750 | 3000 | 30 | 90 | 1150 | 67.5 |
| 27 | 20 | 150 | 3000 | 35 | 100 | 1250 | 12.5 |
| 28 | 40 | 75 | 3000 | 37 | 100 | 1250 | 12.5 |
| 29 | 100 | 30 | 3000 | 38 | 100 | 1230 | 17.5 |

TABLE 3-continued

| Results of Evaluation in Example 2 | | | | | | | |
|---|---|---|---|---|---|---|---|
| 30 | 200 | 15 | 3000 | 36 | 90 | 1200 | 55 |
| 31 | 40 | 75 | 3000 | 34 | 85 | 1200 | 70 |
| 32 | 40 | 75 | 3000 | 33 | 80 | 1250 | 72.5 |
| 33 | 70 | 42 | 2940 | 38 | 100 | 1250 | 12.5 |
| 34 | 60 | 50 | 3000 | 37 | 95 | 1250 | 27.5 |
| 35 | 60 | 50 | 3000 | 36 | 95 | 1150 | 52.5 |
| 36 | 60 | 50 | 3000 | 36 | 95 | 1200 | 40 |
| 37 | 60 | 50 | 3000 | 37 | 95 | 1250 | 27.5 |
| 38 | 400 | 7 | 2800 | 36 | 90 | 1150 | 60 |
| 39 | 70 | 42 | 2940 | 36 | 100 | 1150 | 37.5 |

As shown in Table 3, the samples Nos. 8-39 are superior in toughness, oxidation resistance, and wear resistance because they have the composition meeting the requirement of the present invention.

Incidentally, the samples 8-17 have the composition which meets the requirement of claim 2 but does not meet the requirement of claim 3, and the samples 18-39 have the composition which meets the requirement of claim 3.

Incidentally, the samples 8-17 have the composition which meets the requirement of second aspect of the present invention but does not meet the requirement of third aspect of the present invention, and the samples 18-39 have the composition which meets the requirement of third aspect of the present invention.

The samples 5-7 are good in oxidation resistance because their layers A has the composition meeting the requirement of the present invention; however, they are poorer in toughness than the samples 8-39 because they do not have layers B. They are better in wear resistance than the samples Nos. 1 and 2, which are of conventional type based on TiAlN and TiAlSiN, but is poorer than the samples 8 to 39.

These results suggest that the hard coating film composed of layers A and layers B exhibit better wear resistance than that composed only of layers A when used for cutting of hard materials at a high bearing strength.

By contrast, the samples Nos. 1 and 2 are poor in toughness and oxidation resistance and hence in wear resistance because they are of conventional type (based on TiAlN and TiAlSiN). The sample No. 3 is poor in toughness and wear resistance because the thickness of layers A and layers B is larger than the upper limit. The sample No. 4 is poor in toughness and wear resistance because the thickness of layers A and layers B is smaller than the lower limit.

What is claimed is:

1. A hard coating film to be applied to the surface of a tool, said hard coating film comprising layers A and layers B which are placed alternately one over another, wherein each of said layers A has a composition represented by the formula $Al_{1-a-b}Si_aMg_b(B_xC_yN_z)$, where a, b, x, y, and z represent atomic ratios such that $0 \leqq a \leqq 0.35$, $0 \leqq b \leqq 0.2$, $0.03 \leqq a+b \leqq 0.5$, $0 \leqq x \leqq 0.2$, $0 \leqq y \leqq 0.4$, $0.5 \leqq z \leqq 1$, and $x+y+z=1$;

each of said layers B has a composition represented by the formula $Ti_{1-m-n}Cr_mAl_n(B_oC_pN_q)$, where m, n, o, p, and q represent atomic ratios such that $0 \leqq m \leqq 0.5$, $0.5 \leqq n \leqq 0.75$, $0 \leqq 1-m-n \leqq 0.5$, and $o+p+q=1$; and each of said layers A and layers B has a thickness not smaller than 2 nm and not larger than 200 nm.

2. A tool coated with the hard coating film defined in claim 1.

3. The hard coating film according to claim 1, wherein $0 \leqq a \leqq 0.3$.

4. The hard coating film according to claim 1, wherein $0 \leqq a \leqq 0.2$.

5. The hard coating film according to claim 1, wherein $0 \leqq b \leqq 0.1$.

6. The hard coating film according to claim 1, wherein $0 \leqq x \leqq 0.15$.

7. The hard coating film according to claim 1, wherein $0 \leqq y \leqq 0.2$.

8. The hard coating film according to claim 1, wherein $0.6 \leqq n \leqq 0.75$.

9. The hard coating film according to claim 1, wherein $0.5 \leqq n \leqq 0.7$.

* * * * *